US006364509B1

(12) United States Patent
Johnson, III

(10) Patent No.: US 6,364,509 B1
(45) Date of Patent: Apr. 2, 2002

(54) SOUND RESPONSIVE ILLUMINATION DEVICE

(75) Inventor: Clifford Johnson, III, Dublin, GA (US)

(73) Assignee: J & J Creative Ideas, Dublin, GA (US)

( * ) Notice: Subject to any disclaimer, the term of this patent is extended or adjusted under 35 U.S.C. 154(b) by 0 days.

(21) Appl. No.: 09/607,453

(22) Filed: Jun. 30, 2000

(51) Int. Cl.[7] ..... F21S 13/14

(52) U.S. Cl. ..... 362/252; 362/253; 362/190; 362/276; 446/175; 446/242; 446/438; 446/485

(58) Field of Search ..... 362/227, 249, 362/253, 800, 806, 811, 86, 157, 184, 190, 191, 252, 276; 84/453, 464 R, 464 A; 446/25, 93, 175, 242, 438, 485

(56) References Cited

U.S. PATENT DOCUMENTS

| | | | | | |
|---|---|---|---|---|---|
| 3,949,350 | A | * | 4/1976 | Smith | 362/86 |
| 4,176,581 | A | * | 12/1979 | Stuyvenberg | 84/464 R |
| 4,346,640 | A | * | 8/1982 | Zeno et al. | 84/464 R |
| D266,778 | S | | 11/1982 | Hilko | |
| 4,389,598 | A | | 6/1983 | Smith | |
| 4,753,148 | A | | 6/1988 | Johnson | |
| 4,791,536 | A | * | 12/1988 | James | 362/104 |
| 4,809,584 | A | * | 3/1989 | Forrest | 84/464 R |
| 4,869,699 | A | | 9/1989 | Plambeck et al. | |
| 4,889,027 | A | | 12/1989 | Yokoi | |
| 5,040,319 | A | | 8/1991 | Wang et al. | |
| 5,181,775 | A | * | 1/1993 | Lan | 362/234 |
| 6,164,792 | A | * | 12/2000 | Nakagome | 362/86 |

* cited by examiner

*Primary Examiner*—Sandra O'Shea
*Assistant Examiner*—Isamael Negron

(57) ABSTRACT

A musical light for illuminating an object in an entertaining manner using electrical sound signals produced by an audio device. The musical light includes a circuit adapted for electrically connecting to an audio device. The circuit is mounted on an object to be illuminated. The circuit has first and second leads. The first and second leads are connected to first and second contacts of the audio device. The circuit comprises a plurality of lights and a plurality of wires. The plurality of lights is for mounting on the object. The plurality of wires is designed for connecting the plurality of lights to the first and second leads.

15 Claims, 2 Drawing Sheets

SOUND RESPONSIVE ILLUMINATION DEVICE

BACKGROUND OF THE INVENTION

1. Field of the Invention

The present invention relates to devices for illuminating objects in an entertaining manner and more particularly pertains to a new musical light for illuminating an object in an entertaining manner using electrical sound signals produced by an audio device.

2. Description of the Prior Art

The use of devices for illuminating objects in an entertaining manner is known in the prior art. More specifically, devices for illuminating objects in an entertaining manner heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,389,598; U.S. Pat. No. 5,040,319; U.S. Pat. No. 4,889,027; U.S. Pat. No. 4,869,699; U.S. Pat. No. 4,753,148; and U.S. Pat. No. Des. 266,778.

While these devices fulfill their respective, particular objectives and requirements, the aforementioned patents do not disclose a new musical light. The inventive device includes a circuit adapted for electrically connecting to an audio device. The circuit is mounted on an object to be illuminated. The circuit has first and second leads. The first and second leads are connectable to first and second contacts of the audio device. The circuit comprises a plurality of lights and a plurality of wires. The plurality of lights is for mounting on the object. The plurality of wires is designed for connecting the plurality of lights to the first and second leads.

In these respects, the musical light according to the present invention substantially departs from the conventional concepts and designs of the prior art, and in so doing provides an apparatus primarily developed for the purpose of illuminating an object in an entertaining manner using electrical sound signals produced by an audio device.

SUMMARY OF THE INVENTION

In view of the foregoing disadvantages inherent in the known types of devices for illuminating objects in an entertaining manner now present in the prior art, the present invention provides a new musical light construction wherein the same can be utilized for illuminating an object in an entertaining manner using electrical sound signals produced by an audio device.

The general purpose of the present invention, which will be described subsequently in greater detail, is to provide a new musical light apparatus and method which has many of the advantages of the devices for illuminating objects in an entertaining manner mentioned heretofore and many novel features that result in a new musical light which is not anticipated, rendered obvious, suggested, or even implied by any of the prior art devices for illuminating objects in an entertaining manner, either alone or in any combination thereof.

To attain this, the present invention generally comprises a circuit adapted for electrically connecting to an audio device. The circuit is mounted on an object to be illuminated. The circuit has first and second leads. The first and second leads are connectable to first and second contacts of the audio device. The circuit comprises a plurality of lights and a plurality of wires. The plurality of lights is for mounting on the object. The plurality of wires is designed for connecting the plurality of lights to the first and second leads.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new musical light apparatus which has many of the advantages of the devices for illuminating objects in an entertaining manner mentioned heretofore and many novel features that result in a new musical light which is not anticipated, rendered obvious, suggested, or even implied by any of the prior art devices for illuminating objects in an entertaining manner, either alone or in any combination thereof.

It is another object of the present invention to provide a new musical light, which may be easily and efficiently manufactured and marketed.

It is a further object of the present invention to provide a new musical light, which is of a durable and reliable construction.

An even further object of the present invention is to provide a new musical light which is susceptible of a low cost of manufacture with regard to both materials and labor, and which accordingly is then susceptible of low prices of sale to the consuming public, thereby making such musical light economically available to the buying public.

Still yet another object of the present invention is to provide a new musical light which provides in the apparatuses of the prior art some of the advantages thereof, while simultaneously overcoming some of the disadvantages normally associated therewith.

Still another object of the present invention is to provide a new musical light for illuminating an object in an entertaining manner using electrical sound signals produced by an audio device.

Yet another object of the present invention is to provide a new musical light which includes a circuit adapted for electrically connecting to an audio device. The circuit is mounted on an object to be illuminated. The circuit has first and second leads. The first and second leads are connectable to first and second contacts of the audio device. The circuit comprises a plurality of lights and a plurality of wires. The plurality of lights is for mounting on the object. The plurality of wires is designed for connecting the plurality of lights to the first and second leads.

Still yet another object of the present invention is to provide a new musical light that provides an entertaining effect for a user's favorite object such as a model vehicle.

Even still another object of the present invention is to provide a new musical light that can be used to signify sound production through a light source for entertaining children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
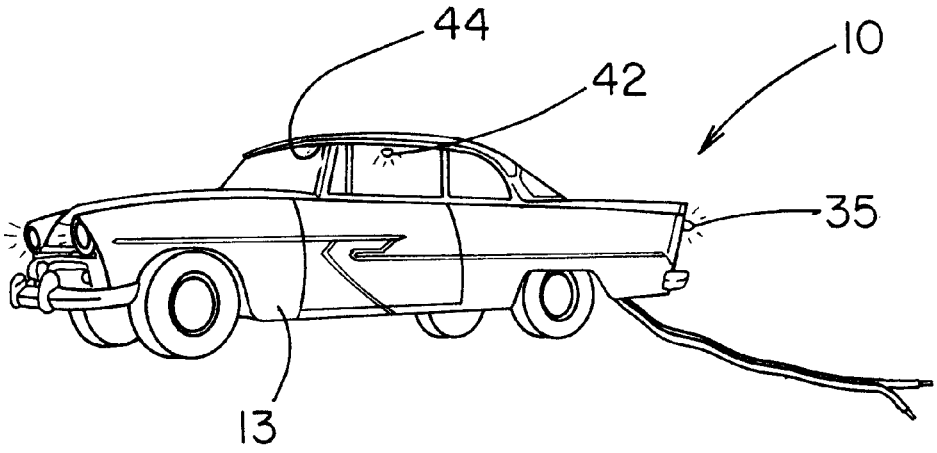
FIG. 1 is a schematic perspective view of a new musical light according to the present invention.
Figure 2:
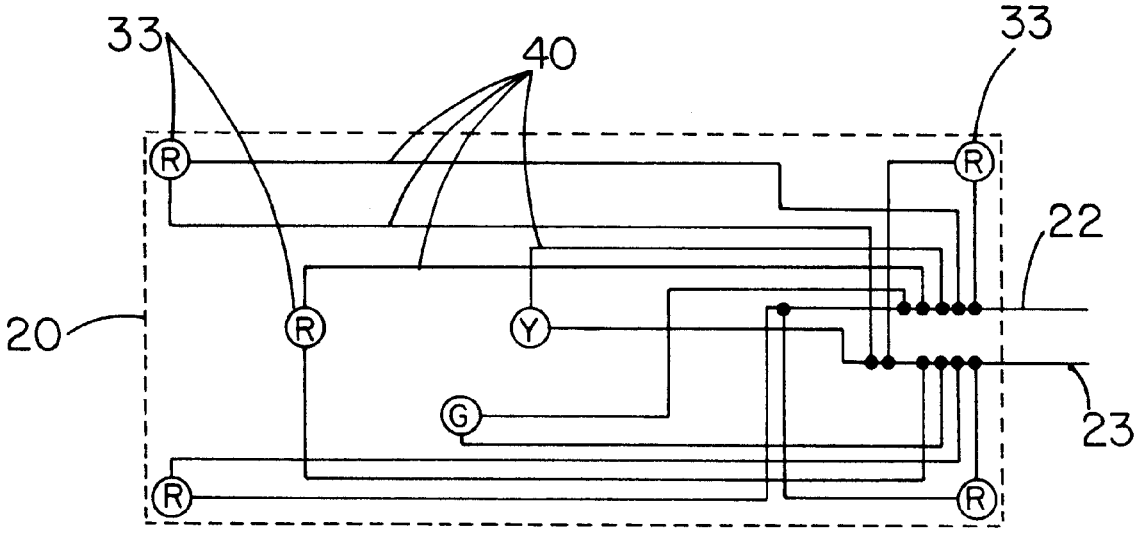
FIG. 2 is a schematic top view of the present invention.
Figure 3:
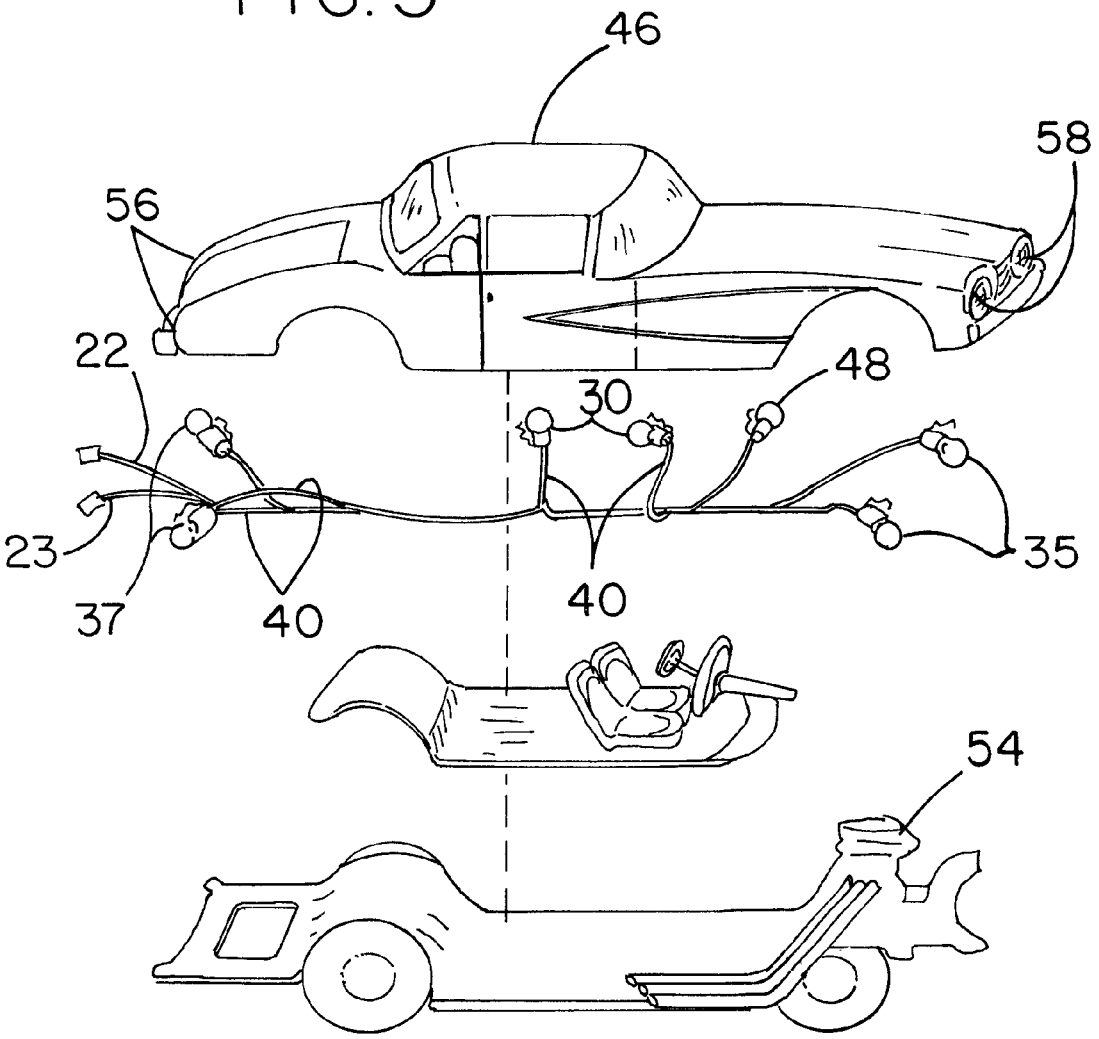
FIG. 3 is a schematic broken away view of the present invention.

With reference now to the drawings, and in particular to FIGS. 1 through 3 thereof, a new musical light embodying the 10 principles and concepts of the present invention and generally designated by the reference numeral 10 will be described.

As best illustrated in FIGS. 1 through 3, the musical light 10 generally comprises a circuit 20 adapted for electrically connecting to an audio device.

The circuit 20 is mounted on an object to be illuminated. The circuit 20 has first 22 and second 23 leads. The first 22 and second 23 leads are connectable to first and second contacts of the audio device.

The circuit 20 comprises a plurality of lights 30 and a plurality of wires 40. The plurality of lights 30 is provided for mounting on the object. The plurality of lights 30 comprises light emitting diodes 33. The plurality of lights 30 may comprise at least seven lights.

The plurality of wires 40 is designed for connecting the plurality of lights 30 to the first 22 and second 23 leads. The plurality of wires 40 connects to the plurality of lights 30 in a parallel manner such that failure of one of the plurality of lights 30 does not affect any other light in the plurality of lights 30.

In one embodiment of the invention, the object illuminated is a model vehicle 13.

A first pair of lights 35 of the plurality of lights 30 may be located at a forward location on the model vehicle 13 for representing headlights. Each of the first pair of lights 35 may be located at a forward corner 58 of the model vehicle 13. The first pair of lights 35 may be adapted to emit a red light.

A second pair of lights 37 of the plurality of lights 30 may be located at a rearward location on the model vehicle for representing taillights. Each of the second pair of lights 37 is located at a rearward corner 56 of the model vehicle. The second pair of lights 37 may be adapted to emit a red light.

A first one 42 of the plurality of lights 30 may be located on an interior surface 44 of a roof 46 of the model vehicle 13. The light 42 may be adapted for representing a dome light. The light 42 may be adapted to emit a yellow light.

A second one 48 of the plurality of lights 30 may be located on an interior surface of an engine compartment of the model vehicle 13. The light 48 may be adapted for illuminating an engine 54 mounted in the engine compartment. The light 48 may be adapted to emit a red light.

One of the plurality of lights may be located on a dash portion of the model vehicle. The light may be adapted for representing a dash light. The light may be adapted to emit a green light.

In use, an object, such as a model vehicle is selected for illumination. An audio device adapted for producing electrical sounds and having first and second output contacts through which audio sounds are transmittable is electrically connected to the circuit. The lights will then flash in accordance with the sound produced from the audio device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for being illuminated in an entertaining manner using electrical sound signals produced by an audio device, the audio device having first and second output contacts through which the electrical sound signals are transmittable, the device comprising:

a circuit adapted for electrically connecting to the audio device, the circuit being mounted on the object, the circuit having first and second leads connected to the first and second contacts of the audio device, the circuit comprising:

a plurality of lights;

a plurality of wires connecting the plurality of lights to the first and second leads;

a model vehicle having a body with the plurality of lights mounted on the body at spaced locations for illuminating spaced portions of the body of the model vehicle, a first pair of lights of the plurality of lights being located at a forward location on the body of the model vehicle for representing headlights, and a second pair of lights of the plurality of lights being located at a rearward location at an opposite end of the body of the model vehicle for representing taillights.

2. The system of claim 1 wherein the plurality of wires connect the plurality of lights in a parallel manner such that failure of one of the plurality of lights does not affect other lights of the plurality of lights.

3. The system of claim 1 wherein each of the plurality of lights comprises a light emitting diode.

4. The system of claim 1 wherein the plurality of lights comprises at least seven lights.

5. The system of claim 1 wherein each of the first pair of lights is located at a forward corner of the model vehicle.

6. The system of claim 1 wherein the first pair of lights are adapted to emit a red light.

7. The system of claim 1 wherein each of the second pair of lights is located at a rearward corner of the model vehicle.

8. The system of claim 1 wherein the second pair of lights are adapted to emit a red light.

9. The system of claim 1 wherein one of the plurality of lights is located on an interior surface of a roof of the model vehicle for representing a dome light.

10. The system of claim 9 wherein the light is adapted to emit a yellow light.

11. The system of claim 1 wherein one of the plurality of lights is located on an interior surface of an engine compartment of the body of the model vehicle to illuminate an engine mounted in the engine compartment.

12. The system of claim 11 wherein the light is adapted to emit a red light.

13. The system of claim 1 wherein one of the plurality of lights is located on a dash portion of the body of the model vehicle for representing a dash light.

14. The system of claim 13 wherein the light is adapted to emit a green light.

15. A system for being illuminated in an entertaining manner using electrical sound signals produced by an audio device, the audio device having first and second output contacts through which the electrical sound signals are transmittable, the device comprising:

a circuit adapted for electrically connecting to the audio device, the circuit being mounted on the object, the circuit having first and second leads connected to the first and second contacts of the audio device, the circuit comprising:

a plurality of lights;

a plurality of wires connecting the plurality of lights to the first and second leads;

a model vehicle having a body with the plurality of lights mounted on the body at spaced locations for illuminating spaced portions of the body of the model vehicle, a first pair of lights of the plurality of lights being located at a forward location on the body of the model vehicle for representing headlights, and a second pair of lights of the plurality of lights being located at a rearward location at an opposite end of the body of the model vehicle for representing taillights;

wherein the plurality of wires connect the plurality of lights in a parallel manner such that failure of one of the plurality of lights does not affect other lights of the plurality of lights;

wherein each of the plurality of lights comprises a light emitting diode;

wherein the plurality of lights comprises at least seven lights;

wherein each of the first pair of lights is located at a forward corner of the model vehicle and the first pair of lights are adapted to emit a red light;

wherein each of the second pair of lights is located at a rearward corner of the model vehicle and the second pair of lights are adapted to emit a red light;

wherein one of the plurality of lights is located on an interior surface of a roof of the model vehicle for representing a dome light and the light is adapted to emit a yellow light;

wherein one of the plurality of lights is located on an interior surface of an engine compartment of the body of the model vehicle to illuminate an engine mounted in the engine compartment and the light is adapted to emit a red light; and wherein one of the plurality of lights is located on a dash portion of the body of the model vehicle for representing a dash light and the light is adapted to emit a green light.

* * * * *